US007874803B2

(12) United States Patent
Whitton

(10) Patent No.: US 7,874,803 B2
(45) Date of Patent: Jan. 25, 2011

(54) GAS TURBINE ROTOR

(75) Inventor: Richard Whitton, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 934 days.

(21) Appl. No.: 11/189,771

(22) Filed: Jul. 27, 2005

(65) Prior Publication Data

US 2006/0024166 A1 Feb. 2, 2006

(30) Foreign Application Priority Data

Jul. 28, 2004 (DE) ..... 10 2004 037 331

(51) Int. Cl.
*F01D 5/30* (2006.01)

(52) U.S. Cl. ..... 416/193 A; 416/500

(58) Field of Classification Search ..... 416/500, 416/248, 193 A, 97 R; 415/97 R
See application file for complete search history.

(56) References Cited

U.S. PATENT DOCUMENTS

| | | | | |
|---|---|---|---|---|
| 4,101,245 | A * | 7/1978 | Hess et al. | 416/190 |
| 6,017,189 | A | 1/2000 | Judet et al. | |
| 6,086,329 | A * | 7/2000 | Tomita et al. | 416/193 A |
| 6,120,249 | A * | 9/2000 | Hultgren et al. | 416/97 R |
| 6,164,658 | A | 12/2000 | Collin | |
| 6,190,130 | B1 * | 2/2001 | Fukue et al. | 416/97 R |
| 6,241,467 | B1 * | 6/2001 | Zelesky et al. | 415/115 |
| 6,254,333 | B1 | 7/2001 | Merry | |
| 6,261,053 | B1 | 7/2001 | Anderson et al. | |
| 6,402,471 | B1 * | 6/2002 | Demers et al. | 416/97 R |
| 6,561,764 | B1 | 5/2003 | Tiemann | |
| 6,568,688 | B1 | 5/2003 | Boeck | |
| 6,641,360 | B2 * | 11/2003 | Beeck et al. | 415/1 |
| 6,945,749 | B2 * | 9/2005 | De Cardenas | 415/115 |
| 2002/0090296 | A1 | 7/2002 | Kuwabara | |

FOREIGN PATENT DOCUMENTS

| | | |
|---|---|---|
| BE | 621931 | 8/1962 |
| DE | 1822762 U | 12/1960 |
| DE | 3328057 A1 | 2/1984 |
| DE | 69819293 T2 | 5/2004 |
| EP | 0856641 | 8/1998 |
| EP | 0 937 863 A2 | 2/1999 |
| EP | 0902167 | 3/1999 |
| EP | 0940561 | 9/1999 |
| EP | 1045178 A2 | 10/2000 |
| EP | 1074695 | 2/2001 |
| EP | 1221539 | 7/2002 |
| GB | 936599 | 9/1963 |
| GB | 1284596 | 8/1972 |
| JP | 07332004 | 6/1994 |

OTHER PUBLICATIONS

European Search Report dated Nov. 10, 2008 from counterpart European patent application.

* cited by examiner

*Primary Examiner*—Edward Look
*Assistant Examiner*—Dwayne J White
(74) *Attorney, Agent, or Firm*—Timothy J. Klima; Shuttleworth & Ingersoll, PLC

(57) ABSTRACT

On a gas turbine rotor with internally cooled airfoils (4) of the turbine rotor blades and a mechanical sealing and damping element arranged between opposite side faces (6) of adjacent blade platforms (7), the gap is additionally aerodynamically sealed against the hot gas flow, by cooling air supplied from a cavity (5) of the airfoils via a cooling duct (9) into the gap between the side faces (6).

10 Claims, 2 Drawing Sheets

GAS TURBINE ROTOR

This application claims priority to German Patent Application DE102004037331.0 filed Jul. 28, 2004, the entirety of which is incorporated by reference herein.

BACKGROUND OF THE INVENTION

This invention relates to a gas turbine rotor comprising a disk and turbine rotor blades held in transverse slots provided at the disk periphery, these rotor blades including an airfoil, a blade platform and a blade root fixed in the respective transverse slot, with the airfoils having cavities flown by cooling air, and with either of the opposite side faces of the blade platforms being provided with a recess accommodating a sealing and damping element bridging the gap between the blade platforms.

Gas turbine rotors of the type described above are known from Specification U.S. Pat. No. 6,561,764 B1, for example. The sealing and damping elements arranged between the side faces of the blade platforms are intended to minimize the ventilation losses and to reduce the vibrations of the turbine rotor blades. With regard to the sealing and damping elements, these gas turbine rotors are disadvantageous in that a single, mechanical seal is not fully effective and will permit hot gas to pass via the gap remaining between the blade platforms into the area beneath the blade platforms and, thus, into the area of fixation of the turbine rotor blades on the disk periphery. This results in a reduction of service life of the rotor disk. Provision of additional mechanical sealing elements between the blade platforms in areas in which the sealing and damping element is not effective requires, however, considerable manufacturing effort and, in addition, may result in stresses.

BRIEF SUMMARY OF THE INVENTION

A broad aspect of the present invention is to provide a gas turbine rotor of the type specified above such that, with low manufacturing effort, hot gas leakages via the gap between the blade platforms are avoided or reduced and, thus, the service life of the rotor disk is increased.

It is a particular object of the present invention to provide solution to the above problems by a gas turbine rotor designed in accordance with the features described herein. Further features and advantageous embodiments of the present invention will be apparent from the description below.

In other words, the basic idea of the present invention is that part of the cooling air fed to the cavities of the respective airfoil for internal and film cooling is continuously directed into the gap between adjacent blade platforms in order to aerodynamically seal this gap, or at least to reduce hot gas leakage or cool the hot gas passing the gap. Thus, excessive thermal load of the rotor disk is avoided and its service life increased.

The supply of cooling air or sealing air, respectively, into the gap is accomplished by at least one air duct which originates at the interior of the airfoil and issues on at least one of the side faces of the blade platform. This means that several air ducts may issue into the gap at both sides and at different positions.

The airflow can enter the gap axially spaced from the mechanical sealing element or act in combination with the mechanical sealing and damping element and augment the sealing effect of the latter.

In an advantageous development of the present invention, at least one distributor channel is formed into the side faces of the blade platforms to enable the sealing air to be distributed in the gap in a well-controlled manner.

BRIEF DESCRIPTION OF THE DRAWINGS

The present invention is more fully described in light of the accompanying drawings showing a preferred embodiment.

In the drawings.

DETAILED DESCRIPTION OF THE INVENTION

Figure 1:
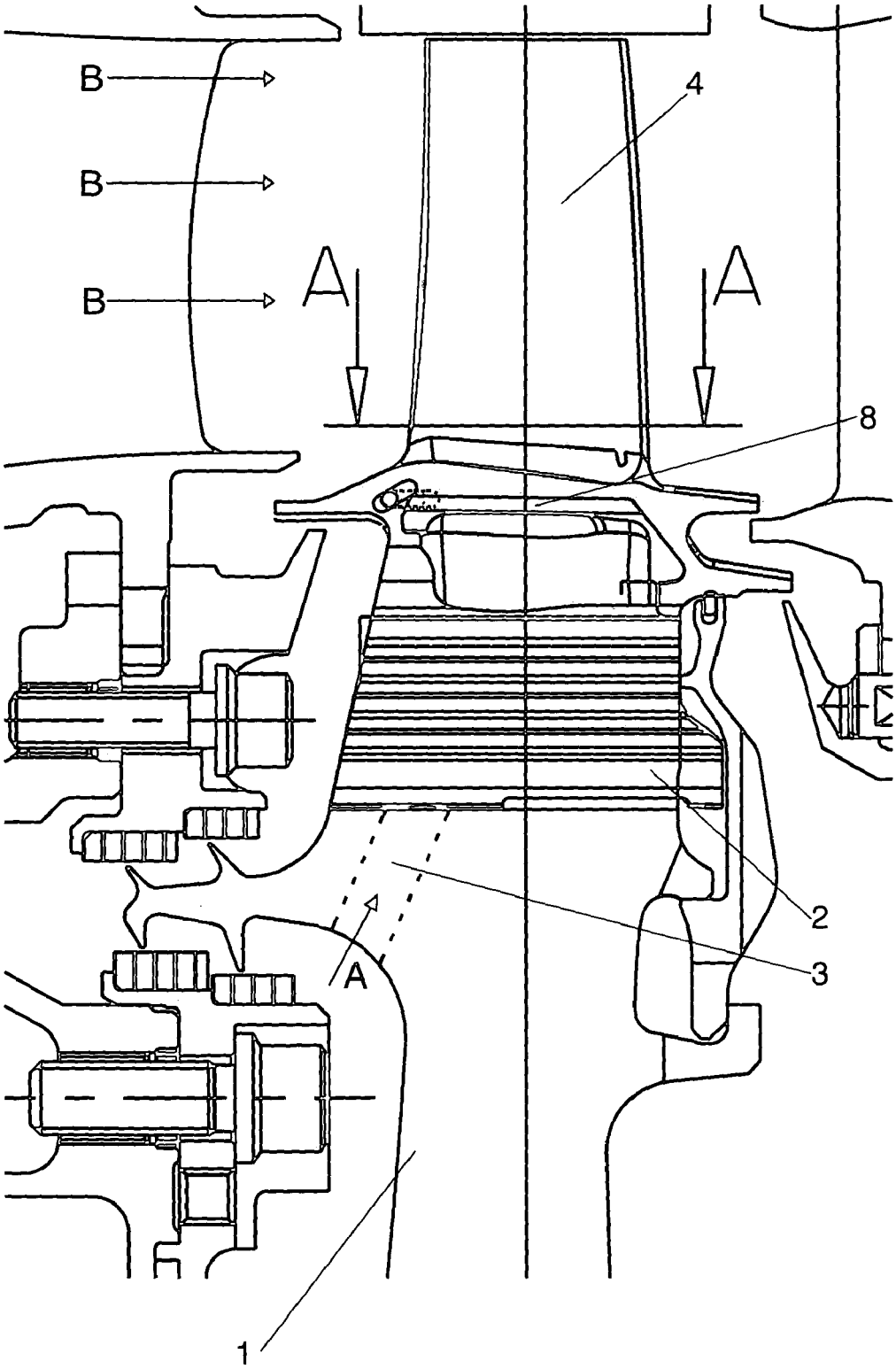
FIG. 1 is a side view of a turbine rotor blade including an airfoil and a blade platform which is arranged in a turbine casing and whose blade root is fixed in a rotor disk.
Figure 2:
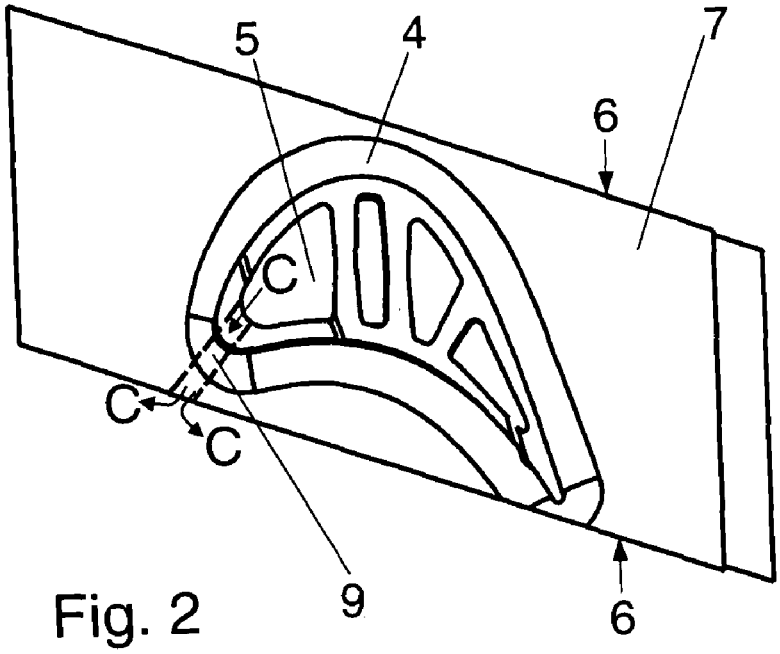
FIG. 2 is a section AA of the turbine rotor blade as per FIG. 1.

A multitude of turbine rotor blades is separably fitted—via their blade roots 2—in transverse slots (not shown) on the periphery of the rotor disk 1. Cooling air tapped from the compressor (arrowhead A) enters the cavities 5 in the respective airfoil 4 via cooling air holes 3 in the rotor disk 1 connecting to holes (not shown) in the blade root 2. Thus, the airfoil 4, which is subject to the hot gas flow (arrowhead B), is cooled internally and by means of a film cooling. In a mid-area of the side faces 6 of the platforms 7 of the turbine rotor blades, recesses 8 for the accommodation of a sealing and damping element (not shown) are provided. The sealing and damping elements arranged between the opposite side faces 6 of adjacent blade platforms 7 are intended to limit rotor blade vibration and contact of the turbine disk with the hot gas. Subject to the design of the blade platforms 7 and for manufacturing reasons, the arrangement of the sealing and damping element is confined to a certain—straight—area of the respective side face. The remaining free gap between the side faces 6 of the blade platforms 7 is shielded against the hot gas atmosphere by a continuous sealing air flow (arrowhead C) supplied from a cavity 5 of the airfoil 4. The sealing air is fed via an air duct 9 issuing immediately at a side face of the platforms, actually in a hot-gas influenced gap area which is not mechanically sealed by a sealing and damping element. In the present embodiment, air entrance is axially separated from the mechanical sealing and damping element. However, the sealing air exit opening may also be arranged in combination with the sealing and damping element such that the sealing effect of the latter is augmented.

In the embodiment described herein, a single air duct 9 with round cross-section is provided. However, two or more air ducts may be provided which can have any cross-sectional shape and can also lead to both side faces 6 of one and the same blade platform 7.

The sealing air entering the space between the side faces 6 of adjacent platforms 7 spreads out in the gap and seals the gap against hot air.

In any case, the colder sealing air will at least cool any hot gas entering the gap. Thus, the ingress of hot gas in the area beneath the platforms is avoided or at least reduced, preventing the attachment of the turbine rotor blade to the rotor disk 1 and the periphery of the latter from being overheated and its service life reduced. Additional mechanical sealing elements, whose manufacture and retention at the periphery of the blade platforms incurs considerable investment, are dispensable.

Figure 3:
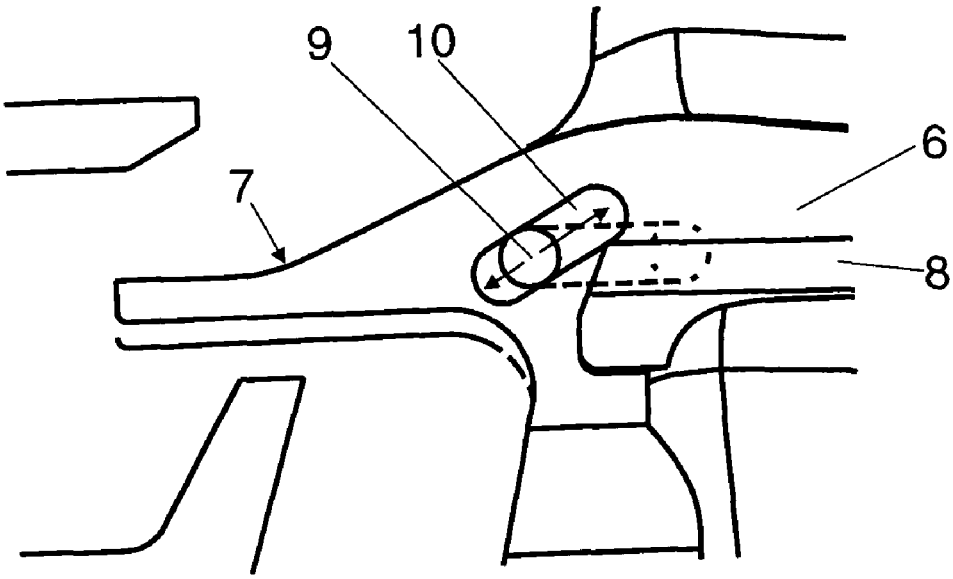
FIG. 3 is a detailed representation of the side face of the blade platform sealed by cooling air in the area not sealed by mechanical means.

As shown on the drawing, in particular FIG. 3, the air duct 9 can also issue into a distributor channel 10 formed into the side face 6 of the platform 7 to distribute the sealing air in the gap between the opposite side faces 6 in a well-controlled manner. The distributor channels 10 can have any shape. Also, several distributor channels can be provided in a side face.

| List of reference numerals | |
|---|---|
| 1 | Rotor disk |
| 2 | Blade root |
| 3 | Cooling air hole |
| 4 | Airfoil |
| 5 | Cavity in 4 |
| 6 | Side face of 7 |
| 7 | Blade platform |
| 8 | Recess |
| 9 | Air duct |
| 10 | Distributor channel |
| Arrowhead A | Cooling air from compressor |
| Arrowhead B | Hot gas flow |
| Arrowhead C | Sealing air flow |

What is claimed is:

1. A gas turbine rotor comprising a rotor disk and turbine rotor blades held in transverse slots provided at the disk periphery, these rotor blades each including an airfoil, a blade platform and a blade root fixed in the respective transverse slot, with the airfoils having cavities flown by cooling air, and with either of opposite side faces of the blade platforms being provided with a recess accommodating a sealing and damping element bridging a gap between the blade platforms, and further comprising at least one air duct connected to at least one cavity in the airfoil which issues on at least one of the side faces of the blade platforms for aerodynamically sealing the gap by supplying an air volume between the blade platforms, wherein the air duct is positioned at a forward end of the blade platform upstream of 1) a leading edge of the airfoil and 2) the sealing and damping element, to aerodynamically seal the gap between forward ends of the blade platforms.

2. A gas turbine rotor in accordance with claim 1, wherein the air duct issues into an air distributor channel formed into the side face of the blade platform.

3. A gas turbine rotor in accordance with claim 2, wherein, at least one of the air duct and the air distributor channel is arranged such that the supply of sealing air is axially separated from the sealing and damping element.

4. A gas turbine rotor in accordance with claim 2, wherein, at least one of the air duct and the air distributor channel are arranged such that the supply of sealing air is also effected in the area of the sealing and damping element.

5. A method of aerodynamically sealing a gap between blade platforms of a gas turbine rotor, comprising:

providing a rotor disk and plurality of turbine rotor blades held in transverse slots provided at the disk periphery the rotor blades each including an airfoil, a blade platform and a blade root fixed in the respective transverse slot, with the airfoils having cavities flown by cooling air, and with either of opposite side faces of the blade platforms being provided with a recess accommodating a sealing and damping element bridging a pap between the blade platforms, providing at least one air duct in each blade platform connected to at least one cavity in the airfoil and which opens on at least one of the side faces of the blade platform, aerodynamically sealing the gap between the blade platforms by supplying air from the at least one cavity through the at least one air duct into the gap between the blade platforms;

and further comprising aerodynamically sealing the gap between forward ends of the blade platforms by positioning the air duct at a forward end of the blade platform upstream of 1) a leading edge of the airfoil and 2) the sealing and damping element.

6. A method in accordance with claim 5, and further comprising issuing the air from the air duct into an air distributor channel formed into the side face of the blade platform.

7. A method in accordance with claim 6, and further comprising arranging, at least one of the air duct and the air distributor channel such that the supply of sealing air is axially separated from the sealing and damping element.

8. A method in accordance with claim 6, and further comprising arranging at least one of the air duct and the air distributor channel such that the supply of sealing air is also effected in the area of the sealing and damping element.

9. A method in accordance with claim 5, and further comprising arranging, at least one of the air duct and the air distributor channel such that the supply of sealing air is axially separated from the sealing and damping element.

10. A method in accordance with claim 5, and further comprising arranging at least one of the air duct and the air distributor channel such that the supply of sealing air is also effected in the area of the sealing and damping element.

* * * * *